United States Patent [19]

Compton

[11] Patent Number: 5,019,705

[45] Date of Patent: May 28, 1991

[54] HIGH BRILLIANCE NEGATIVE ION AND NEUTRAL BEAM SOURCE

[75] Inventor: Robert N. Compton, Oak Ridge, Tenn.

[73] Assignee: The United States of America as represented by the United States Department of Energy, Washington, D.C.

[21] Appl. No.: 460,464

[22] Filed: Jan. 3, 1990

[51] Int. Cl.[5] ..... H01J 3/04; H05H 3/00

[52] U.S. Cl. ..... 250/251; 250/423 P

[58] Field of Search ..... 250/251, 423 R, 423 P, 250/288

[56] References Cited

U.S. PATENT DOCUMENTS

| | | | |
|---|---|---|---|
| 3,617,789 | 11/1971 | Moylan et al. | 250/423 R |
| 3,742,219 | 6/1973 | Damm et al. | 250/251 |
| 3,914,655 | 10/1975 | Dreyfus et al. | 250/423 P |
| 3,987,302 | 10/1976 | Hurst et al. | 250/283 |
| 4,209,704 | 6/1980 | Krimmel | 250/423 P |
| 4,365,157 | 12/1982 | Unsöld et al. | 250/423 P |

OTHER PUBLICATIONS

R. N. Compton et al., "Resonance Enhanced Multiphoton Ionization of Xenon: Photoelectron Energy Analysis", Chemical Physics Letters, vol. 71, No. 1, Apr. 1980.

G. D. Alton, "Ionization Phenomena and Sources of Ions", Applied Atomic Collision Physics, vol. 4, pp. 43–177, 1983.

*Primary Examiner*—Bruce C. Anderson

*Attorney, Agent, or Firm*—David E. Breeden; Stephen D. Hamel; William R. Moser

[57] ABSTRACT

A high brilliance mass selected (Z-selected) negative ion and neutral beam source having good energy resolution. The source is based upon laser resonance ionization of atoms or molecules in a small gaseous medium followed by charge exchange through an alkali oven. The source is capable of producing microampere beams of an extremely wide variety of negative ions, and milliampere beams when operated in the pulsed mode.

5 Claims, 1 Drawing Sheet

HIGH BRILLIANCE NEGATIVE ION AND NEUTRAL BEAM SOURCE

BACKGROUND OF THE INVENTION

This invention relates generally to ion beam sources and more particularly to ion beam sources generated through the use of laser resonance ionization as the initial ionizing mechanism. This invention is a result of a contract with the U.S. Department of Energy.

Many of today's basic and applied research technologies require extremely bright sources of mass selected negative ion beams or neutral beams. Injection into high-energy tandem accelerators relies on intense mass selected negative ion sources. Sputtering and ion implanation of solids also require intense negative ion beams. In the art, various means have been used in the past for producing mass selected negative ion beams and neutral beams which generally require rather complicated components of apparatus to produce the required ion beams. In an attempt to reduce the complexity of ion beam generators, laser applications have been suggested in which the laser light of monochromatic-wavelength resonate with the energy level of the material to be ionized is used to produce mass selected positive ions which are then accelerated from the region onto a substrate or directed into an evacuated beam tube for transport to a location where the ion beam is ultimately used by a utiliation device. The turnable laser provides high intensity and mass selected ion beams of low divergence and narrow energy spread. The present invention relates to this type of ion beam generator.

SUMMARY OF THE INVENTION

It is an object of this invention to provide a high brillance negative ion or neutral beam source using the advantage of laser resonance ionization of atoms or molecules in a small gaseous medium.

Another object of this invention is to provide an ion beam generator as in the above object which is very simple to construct and easy to operate.

Yet another object of this invention is to provide a mass selected beam source as in the above object which is considerably easier to operate and maintain than prior ion sources used in the generation of negative ion and neutral beams.

Other objects and many of the attending advantages of the present invention will become apparent to those skilled in the art from the detailed description of a preferred embodiment of the invention taken in conjunction with the drawings.

In summary, the present invention is a high brilliance negative ion beam or neutral beam source having good energy resolution. The source is based upon laser resonance ionization of selected atoms or molecules in a small gaseous medium to produce positive ions of the selected species followed by charge exchange through an alkali oven, for example, to produce neutral and negative ions. The source may be used to produce microampere beams of an extremely wide variety of negative ions in the steady state mode and milliampere beams when operating in the pulsed mode. The source is simple and inexpensive, is not mass limited, and should have a long maintenance-free operating life. Another advantage of the laser ionization technique is that isomers (elements of the same atomic weight but different atomic number) could be selected in this ion source which is not possible in other mass selected devices.

DETAILED DESCRIPTION OF A PREFERRED EMBODIMENT

Figure 1:
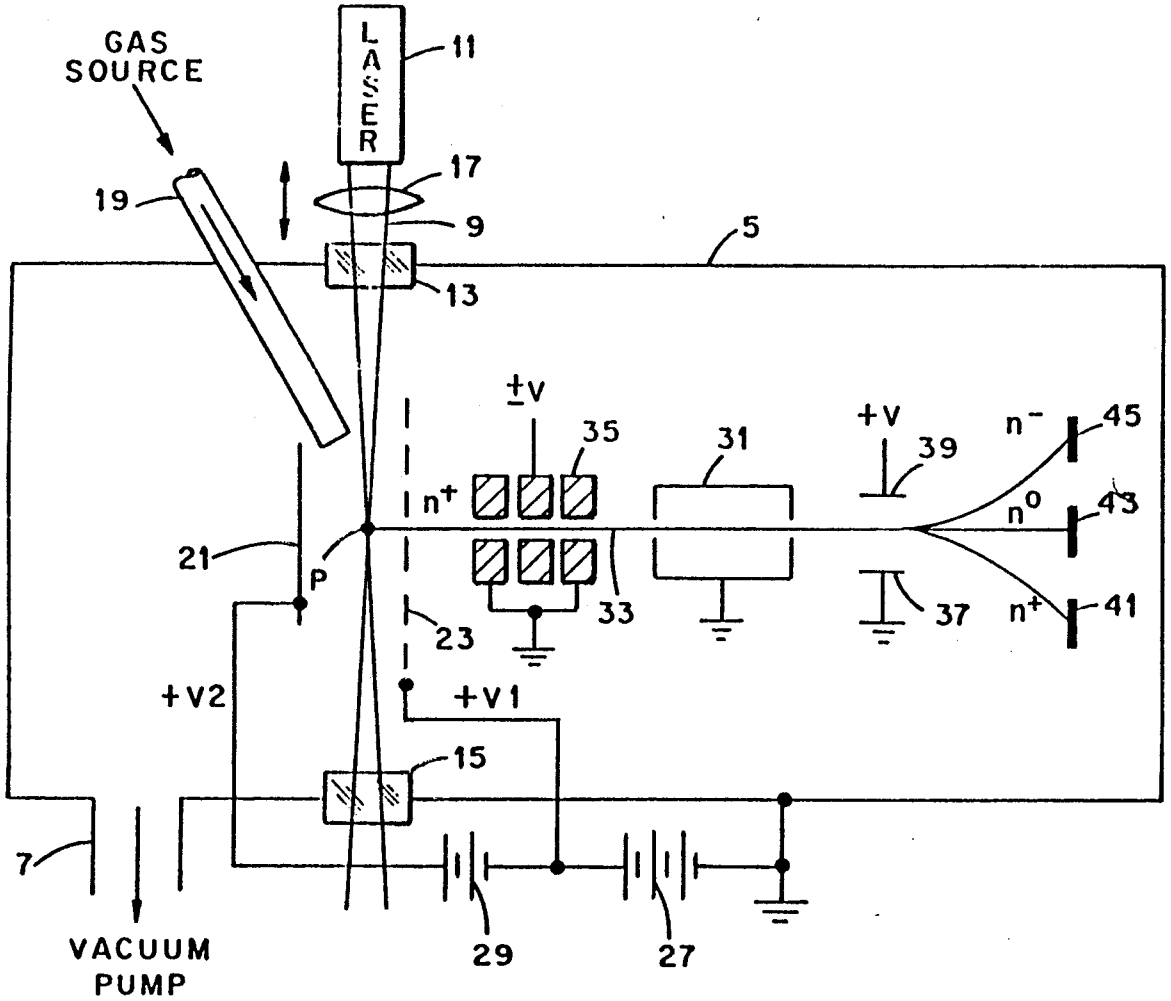
FIG. 1 is a schematic diagram of a high brilliance negative ion and neutral beam source according to the present invention.

With reference to FIG. 1, it will be seen that the invention is based upon laser resonance ionization of atoms and molecules to produce positive ions at a point P along the beam path followed by charge exchange through an alkali oven, for example, to produce negative ions and neutral particles from the positive ions. The entire system is enclosed in a vacuum housing or chamber 5. The housing is connected in fluid communication with a vacuum pump (not shown) through a duct 7. A laser beam 9, is directed into the chamber 5 from a laser 11 which has a wavelength selected for the energy levels of the particular gaseous medium to be ionized at the point P within the evacuated chamber 5. The beam 9 passes through a window 13 as it enters the chamber and exits the chamber through a second window 15 disposed in the opposite wall of the chamber 5.

Typically, the type of laser used in a conventional tunable dye laser and the beam is focused onto the point P by means of a focusing lens 17 oriented in the path of the beam 9. This lens may be movably disposed, as shown, so that the focal point P may be positioned within the chamber to provide alignment of the exiting ion beam or to modulate the beam displacement.

The specific gas used to produce the ion beam is introduced through a supply tube 19 to an area within the evacuated chamber 5 close to the focal point P of the laser beam. Since the ionization of the gas is focused at a point P is a very small amount of the source gas entering through the tube 19 is necessary to feed the system and thus does not disrupt the vacuum containment. An electric field is applied in the volume at the point P by means of grids 21 and 23. The grid 23 is an open grid which allows ions produced at the point P to pass therethrough under the influence of an electric field applied by the DC sources 27 and 29. Grid 23 is biased negative with respect to grid 21 so that the positive ions are drawn out of the ion generation region through the grid 23. A small voltage, typically 10–100 volts is applied across the grids by source 29 to sweep the ions from the area between the electrodes 21 and 23 toward a charge exchange cell, such as an alkali oven 31. The oven is negatively biased with respect to the grid 23 by connecting the oven housing to ground so that the voltage applied between the grid 23 and the oven 31 accelerates the ions in the desired direction along the beam path 33.

The positive ion beam is accelerated by the high voltage of source 27 applied to the grid 23, which is appropriate for the desired ion energy. The accelerated beam of positive ions ($n^+$) passes through the alkali oven 31 wherein a double charge exchange produces both neutral particles $n^\circ$ and negative ions$^-$in the beam from the positive ions $n^+$. The positive ion beam emerging through the grid 23 from the ion generation region may be focused by means of an electrostatic focusing lens 35. The ion lens shown in FIG. 1 is a three element Einzel lens; however, any ion focusing lens of appropriate properties may be used.

Figure 2:
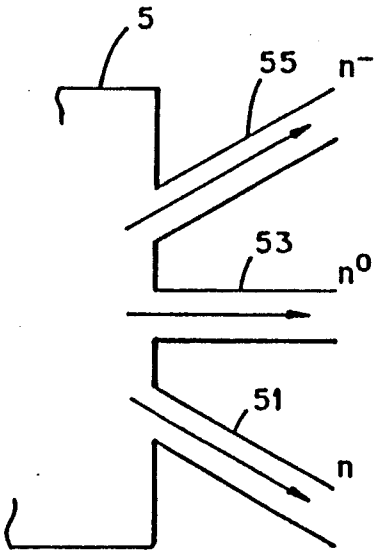
FIG. 2 is a partial schematic, illustrating an alternative utilization of the three ion beams produced by the source which pass into evacuated beam drift tubes.

The beam 33 may be separated into three separate beam components of neutral, negative, and positive ion beams by means of an electric field produced by applying a voltage +V between plates 37 and 39 disposed parallel to the direction of the beam 33 so that the electric field gradient is perpendicular to the beam. The three beam components may be directed onto separate utilization devices 41–45, respectively, depending on the application. Alternatively, as shown in FIG. 2, the beams may be directed into separate beam transport tubes 51–55, as shown, to direct the separate beams to selected utilization locations.

In addition, a further set of beam-steering electrodes, not shown, like plates 37 and 39 may be disposed parallel to the beam to generate an electric field gradient orthogonal to that generated by the plates 37 and 39. With the two sets of plates, both the negative and positive ion beams could be directed to a point or swept over a substrate or other utilization device. For example, site selected ion implanation could be carried out on a solid substrate.

Returning now to FIG. 1, the grids 21 and 23 are typically separated approximately 1 to 3 centimeters and are oriented such that the back grid 21 is a solid plate and the grid 23 is a mesh grid which allows the bright positive ion beam to pass along the desired beam path 33. The grids are oriented perpendicular to the direction of positive ion beam $n^+$existing from the grid 23.

In operation, the laser beam from the laser 11, having a wavelength selected in accordance with the desired ion species to be generated, is directed into a small volume, indicated by point P on FIG. 1, in the ion generation region betweeen the grids 21 and 23. The source gas is introduced through the tube 19 and the proper bias voltages are applied from the sources 27 and 29. The atoms or molecules introduced are ionized by resonance enhanced multiphoton ionization. Most elements of the periodic chart may be ionized with almost 100% efficiency. For example, if xenon is to be the ion species, a laser beam wavelength of 4408 angstroms produced by a $10^5$ watt dye laser focused to approximately $10^{10}$ Watts/cm$^2$ is used to ionize the xenon atoms. The voltage applied between the grid 23 and ground, which is the oven potential, is typically between 100 and 1,000 V, which accelerates the positive ions toward the oven 31 at a beam energy of approximately 100 eV to 1,000 keV. The final ion or neutral beam energy is determined by the user. The energy for optimum negative ion and neutral beam intensity is determined by the physics of the collison for each colliding pair.

The positive ions are therefore mass selected, or selected by atomic number, and are very highly monochromatic. Since all of the ions are created at a point P in a very small volume, the ion source has high brilliance, i.e., a very large concentration of ions per unit volume. The beam energy which depends upon the bias from source 27 applied between the oven 31 and the grid 23, may vary from 1 to 200 keV energy beams.

Thus it will be seen that an extremely simple ion source has been provided which will produce positive, negative, and neutral beams simultaneously with the positive and neutral beams estimated to be about ten times larger than the negative beam. This course is especially capable of producing negative ions of $He^-$, $Ar^-$ and $Xe^-$. Unlike mass spectrometer based systems, where the desired ion species must be separated from other ions, there is no upper limit to the mass of ions which can be produced. Also isomers of atomic molecules can be separated using the resonance ionization technique. There are probably only a few elements like fluorine that might not lend themselves to easy use. The group I and group II elements may be particularly well suited to this ion source. Resonance enhanced ionization by the laser wavelength is used to selectively ionize only the desired species, either atoms or molecules. Any mass that can be made an ion by resonance ionization becomes a natural potential source of negative ions. The source has a long operating life since little maintenance is required. Since the ionization takes place in a gaseous medium, this means that there are no parts to replace and no parts within the source ion generating region requiring alignment, etc. The source operates at room temperature and therefore pyrolysis of the gas sample is not expected.

The source may be switched from one ion to another rather easily by turning the dye laser for the desired species and changing the ion source gas introduced into the tube 19. As an example, for any source gas that contains all the group IA metals (lithium, potassium, sodium, rubidium, and cesium) there may be selective ionization of any one of the species without having to reload the source of change a mass spectrometer arrangement as in other ion sources.

One of the main advantages of the invention is that the ion beam has high brilliance since the laser is focused onto a small spot P as shown in FIG. 1. The high number of ions produced per cubic centimeter translates into a high brilliance. Pulsed negative ion beam currents in excess of 1 milliampere and continuous average beam currents of well over 1 microampere may be realized from the source as illustrated herein. The high beam brilliance assures extremely good energy resolution. That is, since the ions are produced in a small volume, they are all created with essentially the same energy. When they are accelerated through the apparatus to ground, the difference in the energy of a given ion packet is small compared to the total beam energy. A resolution of less than 1 eV at 60 keV of energy, which is quite high, is expected.

In certain research applications, a laser-based ion source that can deliver a pulse of ions upon demand would be a significant advantage over conventional continuous or pulsed mode ion sources. The continuous sources are on all the time, and the pulsed sources are temperamental and lack the precision that laser-based ionization affords in this source.

Although the invention has been illustrated by means of a specific example, it will be obvious to those skilled in the art that various modifications and changes may be made therein without departing from the spirit and scope of the invention as set forth in the following claims.

What is claimed is:

1. An ion beam generator for generating high brilliance neutral particle and negative ion beams of a selected species, comprising:

a vacuum housing for enclosing an ion generating region into which a selected gaseous material to be ionized is introduced;

means for introducing a laser beam into said ion generating region at a focal point (P) corresponding to a location along a desired beam path and having a wavelength and beam energy sufficient to produce positive ions of said selected gaseous material through resonance enhanced photoionization;

means for generating an electric field in said generating region to accelerate ions of said selected material produced in said region along said beam path;

means for introducing a charge exchange medium in said beam path for converting a portion of said positive ions of said material produced in said ion generating region to neutral particles and negative ions of said selected material; and means located downstream of said exchange medium along said beam path for redirecting said positive ions and said negative ions along separate beam paths from the neutral particle beam path.

2. An ion beam generator as set forth in claim 1 wherein said means for introducing a laser beam into said region includes a tunable laser source and a focusing lens disposed in the path of said laser beam to focus said beam at said point P in said ion generating region.

3. An ion beam generator as set forth in claim 2 wherein said focusing lens is adjustably disposed to provide selected location of said focal point P within said ion generating region.

4. An ion beam generator as set forth in claim 1 wherein said means for introducing a charge exchange medium into said beam is an alkali oven.

5. An ion beam generator as set forth in claim 1 further including means for introducing said selected gaseous material into said region at a position adjacent said focal point of said laser beam so that a high concentration of said selected material is present in said ion generation region in an area at said focal point to produce a high brilliance ion beam.

* * * * *